US009078493B2

(12) United States Patent
Bradford

(10) Patent No.: US 9,078,493 B2
(45) Date of Patent: Jul. 14, 2015

(54) FOOTWEAR ASSEMBLY

(75) Inventor: Ernesto Juan Bradford, Ocala, FL (US)

(73) Assignee: Body Fort, LLC, Aventura, FL (US)

( * ) Notice: Subject to any disclaimer, the term of this patent is extended or adjusted under 35 U.S.C. 154(b) by 536 days.

(21) Appl. No.: 13/315,663

(22) Filed: Dec. 9, 2011

(65) Prior Publication Data

US 2013/0145653 A1 Jun. 13, 2013

(51) Int. Cl.

| | |
|---|---|
| ***A43B 7/22*** | (2006.01) |
| ***A43B 13/14*** | (2006.01) |
| ***A43B 13/42*** | (2006.01) |
| ***A43B 13/18*** | (2006.01) |

(52) U.S. Cl.

CPC ..... *A43B 13/42* (2013.01); *A43B 13/145* (2013.01); *A43B 13/187* (2013.01)

(58) Field of Classification Search

CPC ..... A43B 13/42; A43B 13/14; A43B 13/189; A43B 13/186; A43B 13/187; A43B 13/188; A43B 13/181; A43B 13/16

USPC ..... 36/103, 25 R, 30, 31, 141, 140, 28

See application file for complete search history.

(56) References Cited

U.S. PATENT DOCUMENTS

| | | | | |
|---|---|---|---|---|
| 3,407,406 | A | 10/1968 | Werner et al. | |
| 3,971,839 | A | 7/1976 | Taylor | |
| 4,658,515 | A * | 4/1987 | Oatman | 36/44 |
| 4,821,431 | A | 4/1989 | Rieffel | |
| 4,914,837 | A | 4/1990 | Rieffel | |
| 4,970,807 | A * | 11/1990 | Anderie et al. | 36/28 |
| 5,383,290 | A | 1/1995 | Grim | |
| 5,392,534 | A | 2/1995 | Grim | |
| 5,617,650 | A | 4/1997 | Grim | |
| 5,667,895 | A | 9/1997 | Jenkner | |
| 6,061,928 | A * | 5/2000 | Nichols | 36/28 |
| 6,413,455 | B1 | 7/2002 | Yates | |
| 6,782,639 | B1 | 8/2004 | Muller | |
| 6,782,640 | B2 | 8/2004 | Westin | |
| 6,848,200 | B1 | 2/2005 | Westin | |
| 7,037,571 | B2 * | 5/2006 | Fish et al. | 428/166 |
| 8,671,591 | B2 * | 3/2014 | Brown | 36/43 |
| 2006/0010717 | A1 | 1/2006 | Finkelstein | |
| 2006/0130363 | A1 * | 6/2006 | Hottinger | 36/28 |
| 2008/0060221 | A1 * | 3/2008 | Hottinger | 36/28 |
| 2009/0313853 | A1 * | 12/2009 | Tadin | 36/91 |

FOREIGN PATENT DOCUMENTS

| | | |
|---|---|---|
| WO | 2011/028084 | 3/2011 |

* cited by examiner

*Primary Examiner* — Jila M Mohandesi
(74) *Attorney, Agent, or Firm* — Klarquist Sparkman, LLP

(57) ABSTRACT

A footwear assembly requires a wearer to adjust in order to maintain stability while standing, walking, etc. The assembly includes an outer sole having a flexible shell surrounding a hollow interior substantially filled by a plurality of unconnected, substantially non-deformable particles. Foot pressure applied to the outer sole results in movement of the plurality of particles, and the resiliency of the shell allows it to assume a variety of different configurations based in part on the portion to which pressure is applied. The resiliency of the shell further facilitates normal biasing thereof and the particles therein into a normal, non-compressed orientation. The tendency of the outer sole to assume a variety of different configurations will, in some circumstances, require a wearer to adjust the corresponding foot and/or leg in order to maintain normal stability, at least when foot pressure is applied to the outer sole.

21 Claims, 5 Drawing Sheets

SECTION CENTER-CENTER

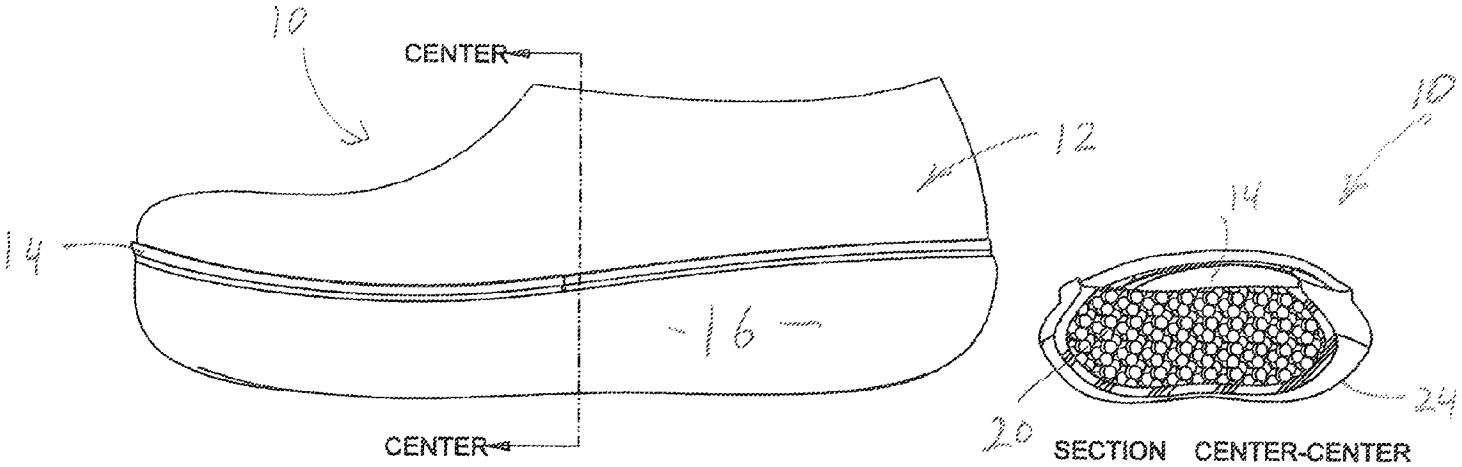
FIG. 3A
FIG. 3B
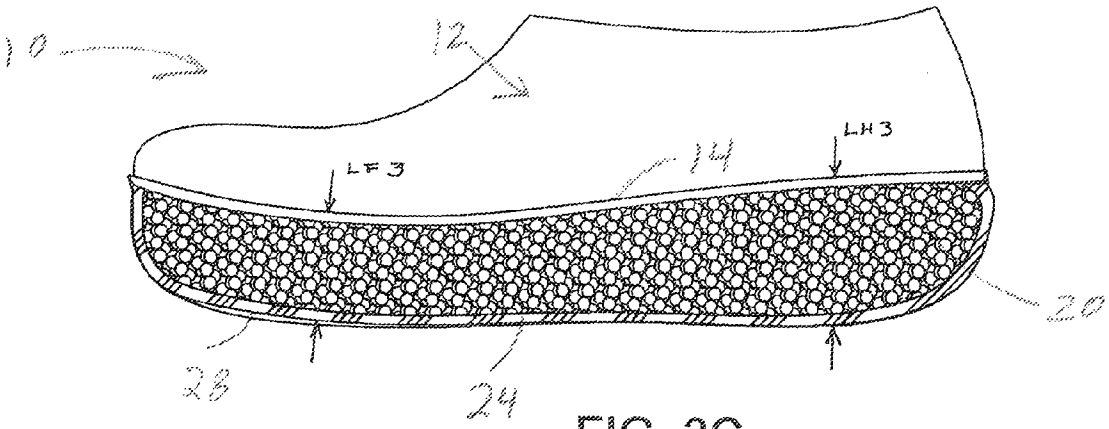
FIG. 3C

FOOTWEAR ASSEMBLY

BACKGROUND OF THE INVENTION

1. Field of the Invention

The present invention is directed to an assembly for footwear which requires adjustments by a wearer in order to maintain normal stability when the footwear is being worn. Such stability adjustments will result in the exercise and eventual strengthening of the foot and leg which does not occur when wearing conventional footwear. The footwear assembly includes an outer sole comprising a flexible material shell at least partially defining a hollow interior into which a plurality of substantially non-deformable, unconnected particles are movably retained. Applied foot pressure is transferred to the particles resulting in a change in the configuration of the outer sole and the creation of minor instabilities of the corresponding foot and leg, thereby requiring stability adjustments by the wearer.

2. Description of the Related Art

The field relating to shoes and/or soles for shoes is vast. Typically, known or conventional footwear include structural features directed towards creating a better support and comfortable fit as well as a stable grip of the outer sole with a supporting surface.

It is widely known that the exercise of walking barefoot on loose sand requires a greater effort than that of walking on firm ground. Therefore, walking barefoot on sand is excellent for the muscles of the feet, ankles and calves, and facilitates the expenditure of more calories. Accordingly, shoes have been produced that purportedly mimic walking on sand. However many shoes of this type have either a solid support or a support at least partially filled with air, wherein creation of the mimicked movement is derived from the bottom or outer portion of the sole. As a result, the corresponding foot is not truly going through the deformations provided by a substratum such as loose sand. In addition, conventional footwear of this type is generally incapable of exercising the foot, ankle, or leg of the wearer while standing still.

There have been numerous studies regarding the mechanics and of human locomotion on sand. In particular, a study done in 1998 by T. M. Lejuene, P. A. Willems and N. C. Heglund concludes that walking on sand requires 1.6-2.5 times more mechanical work than does walking on a hard surface at the same speed. Further, walking on sand requires 2.1-2.7 times more energy expenditure than does walking on a hard surface. The increase in expenditure of energy is due primarily to two factors: the mechanical work done on the sand, and a decrease in efficiency of positive work done by the muscles and tendons of the corresponding foot and leg.

Moreover, The Journal of Experimental Biology 201, 2071-2080 (1998), printed in Great Britain, and The Company of Biologists Limited 1998 JEB1432 indicates that barefoot walking on sand allows irregularities in the surface to move the tarsal, metatarsal, and toes (bones of the foot) relative to each other. The muscles of the foot and the intrinsic foot ligaments are therefore required to produce stabilization between bones. Muscles become fatigued as a consequence and ligaments are subject to increased strain. Should one desire to keep the muscles of the foot in good working order, walking barefoot, particularly on sand, is a good training method (Biomechanical Analysis of Fundamental Human Movement, Arthur E. Chapman).

Accordingly, there is a need in the construction and design of footwear which facilitates the strengthening of the foot, ankle, and lower leg of the wearer by providing at least a minimal amount of instability. As such, a proposed and improved footwear assembly would automatically or inherently require the wearer to make adjustments as foot pressure is applied to the proposed footwear to maintain stability in walking or standing. Such inherent adjustments by the wearer would thereby serve to effectively strengthen the foot, ankle, and lower leg. Such strengthening is at least partially due to the aforementioned "stability adjustments" being made on a substantially continuous basis as the various portions of the wearer's foot strikes the ground or other supporting surface while walking, standing, etc.

In addition, such a proposed footwear assembly should have structural features which allow the wearing thereof in a substantially normal fashion but which typically requires the stability adjustments of the wearer in a manner which does not significantly impede the overall balance and/or intended travel of the wearer over any type supporting surface.

Accordingly, the footwear assembly of the present invention provides a wearer with a totally different walking experience than that offered by known or conventional footwear. More specifically, the use of the proposed footwear assembly closely mimics the feeling of the wearer walking on loose sand. As such, the wearer may feel similar sensations as well as acquire the same benefits as if he/she were walking barefoot on loose sand. Moreover, the wearer of the proposed footwear assembly will be able to reap the above noted benefits, while having the bottom of the foot protected from cuts, lacerations, etc., which commonly occur when actually walking barefoot.

SUMMARY OF THE INVENTION

The present invention is directed to a footwear assembly structured to purposefully promote at least a minimum degree of instability while walking, standing or otherwise when foot pressure is applied to the footwear. As a result, the structural and operative features of the various embodiments of the footwear assembly facilitate automatic or inherent "stability adjustments" by the wearer. Such stability adjustments will serve to rectify the intended instability of the footwear, thereby requiring the muscles and tendons of the corresponding foot and lower leg to work harder in order to overcome any instability. Therefore, when the footwear assembly of the present invention is worn, the structural and operative features thereof will result in a taxation of the locomotive forces of the corresponding foot and leg when walking, running, etc. As a result minor stability adjustments will be made allowing or automatically requiring the wearer to exercise corresponding feet and leg muscles.

As used herein, the term "footwear assembly" is meant to include a shoe structure which may have a variety of different design features and styles in order that the shoe(s) of the wearer correspond to an environment or activity in which the wearer participates. As also noted, the description of the "footwear assembly" provided herein will be primarily directed to a single shoe. However, as should be apparent the structural and operative features of the described single shoe will be applicable to both shoes of a wearer.

Therefore, the footwear assembly of the present invention is structured to facilitate stability adjustments by a wearer concurrent to an application of foot pressure to the footwear or shoe, wherein the intended at least minimal instability of the footwear is at least partially dependent on the application of foot pressure to different portions thereof. Accordingly, the footwear assembly of the present invention comprises an upper structured, dimensioned and configured to receive and retain the foot of the wearer therein. As set forth herein, the upper may comprise a variety of different style configurations, dependent on the intended use of the footwear assembly. In addition, the footwear assembly includes an outer sole and an inner sole, wherein the inner sole is disposed in a segregating relation between the interior portions of the upper and the outer sole.

The outer sole includes a hollow interior having a particulate filler disposed therein. In the various embodiments of the present invention, the particulate filler comprises a plurality of unconnected particles which are sufficient in quantity and size to substantially fill the hollow interior of the outer sole. As will be apparent hereinafter, the term "substantially fill" includes the fact that certain air spaces will exist between the plurality of unconnected particles as the particles move relative to one another within the hollow interior of the outer sole, at least upon the application of foot pressure to the inner sole and/or outer sole.

Moreover, the plurality of particles are formed of a sufficiently non-deformable material to facilitate their movement relative to one another and relative to an inner surface of the outer sole, when foot pressure is applied to the footwear. The outer sole comprises a shell formed of a flexible material and disposed in at least partially enclosing, retaining relation to the plurality of particles. As such, the plurality of particles are movably retained and enclosed within the hollow interior of the outer sole. The flexible material from which the shell is formed also includes sufficient resiliency to assume a variable configuration such as, but not limited to, a laterally outward extension of the shell towards and possibly beyond corresponding sides of the upper of the footwear. The change in the shape of the flexible shell occurs when foot pressure is applied to the inner sole and a correspondingly disposed plurality of particles during walking, running, standing, etc.

It is to be noted that different portions of the shell may extend laterally outward or be otherwise deformed, as set forth above, dependent on the different portions of the inner sole and outer sole to which the pressure is applied. By way of example only, during a normal "walking step", foot pressure may be initially applied to the heel portion of a shoe. As a result, the lateral portions of the heel of the shell of the outer sole may be at least partially "deformed" such as by extending laterally outward towards and/or beyond a corresponding side of the outer, in that foot pressure is applied primarily to the heel portion of the footwear. As the "walking step" proceeds, the foot pressure will be effectively transferred from the heel to a center or mid portion of the shoe, thereby resulting in lateral portions of the heel being retracted into a somewhat normal or non-compressed position. Concurrently, the mid portion of the shell will have its lateral portions extend outward, possibly beyond the corresponding sides of the upper.

In addition, the flexible material of the shell includes sufficient resiliency to move between the aforementioned outwardly extended configurations and a normal position or orientation, dependent on whether foot pressure is being applied to corresponding portions of the inner sole, shell and/or outer shell. Therefore, the resiliency of the shell is sufficient to move between a "compressed orientation" and a "non-compressed orientation" dependent in part on whether foot pressure is being applied to a given portion of the footwear such as the heel, mid-sole, toe, etc. Moreover, the non-compressed orientation of the shell is at least partially defined by an absence or at least a reduction of foot pressure on a specific portion of the footwear as described in the above-noted examples. Further, in at least one embodiment the flexible material of the shell is sufficiently resilient to normally bias the shell into the configuration corresponding to the non-compressed orientation when foot pressure is non-existent or significantly reduced to the footwear.

Additional structural and operative features of the various embodiments of the footwear assembly include the plurality of particles defining the particulate filler being structured of a rigid or at least semi-rigid, substantially non-deformable material. As a result, engagement or contact between adjacently disposed particles, such as upon the application of foot pressure, will result in a "fluid-like movement" relative to one another and to the interior surface of the shell. The desired and at least minimal instability of the outer sole and the corresponding footwear will thereby be facilitated, when retained on the foot of a wearer.

Also, the number and size of the plurality of particles may vary within certain dimensional parameters, it being understood that particles which are too large will diminish or prohibit the "fluid-like movement" of the particles relative to one another. In contrast, the dimensional characteristics of the plurality of particles being within a range of sizes will result in the aforementioned desired minimal instability as well as the development of a "massaging action" being applied to the wearer's foot, at least while walking or running.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 3A is a side view of the embodiment of FIGS. 1 and 2 in a "mid-stride position".

FIG. 3B is a transverse sectional view along a corresponding section line of FIG. 3A.

FIG. 3C is a longitudinal sectional view of the embodiment of FIGS. 3A and 3B.

Like reference numerals refer to like parts throughout the several views of the drawings.

DETAILED DESCRIPTION

Figure 1B:
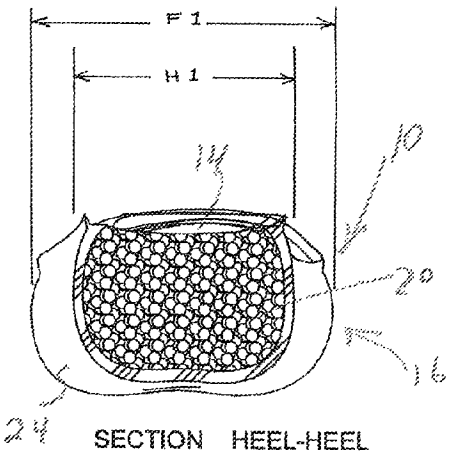
FIG. 1B is a transverse sectional view along a corresponding section line of FIG. 1A.

As represented in the accompanying drawings, the footwear assembly is generally indicated as 10 and comprises an upper 12 structured to retain a wearer's foot on an interior thereof. As such, the upper 12 may assume a variety of different structural characteristics so as to conform or correspond to different styles and/or different uses for which the footwear assembly 10 is intended. By way of example only, the upper 12 may be structured, dimensioned and/or configured to correspond to a sandal, sport shoe, casual shoe, etc.

In addition, each shoe of the footwear assembly 10 includes an inner sole 14 and an outer sole, generally indicated as 16. The outer sole 14 comprises a substantially hollow interior 18 containing a particulate material filler, more specifically defined by a plurality of particles 20. Further, the plurality of particles 20 are collectively sufficient in number and/or dimension to substantially fill the hollow interior 18. As a result, the plurality of particles 20 are or will be disposed in direct confronting engagement with other, adjacently disposed particles 20, upon the application of foot pressure thereto. Moreover, the plurality of particles 20 are not connected to one another and as a result, the application of foot pressure thereto results in their confronting engagement and their individual and collective movement within the hollow interior 18 and relative to an inner surface 22 of a shell 24, at least partially defining the outer sole 16.

Additional features of the plurality of particles 20 include their formation and/or structuring from a rigid, semi-rigid and/or substantially non-deformable material. As such, forced, confronting engagement of the plurality of particles 20 with one another will cause a substantially "fluid-like motion" thereof within the hollow interior 18, upon the application of foot pressure thereto, as set forth above.

Moreover, the fluid-like motion of the plurality of particles 20 within the hollow interior 18 relative to one another and to the interior surface 22 of the shell 24 is facilitated by the flexible/resilient characteristics of the shell 24. In addition, inner sole 14 is also formed of a flexible material and has a sufficiently reduced thickness to facilitate the transfer of applied foot pressure to the correspondingly disposed plurality of particles 20 disposed in the hollow interior 18 beneath the inner sole 14. In turn, the applied foot pressure and the forced movement of the plurality of the particles 20 will be transferred to the corresponding portions of the shell 24. This transfer of forces, generated by the applied foot pressure, is due to the substantially non-deformable nature of the plurality of particles 20 as well as the flexible/resilient characteristics of the inner sole 14 and the shell 24.

As emphasized in greater detail hereinafter, inner sole 14 comprises a sufficiently thin, flexible material so as to conform to the shape of the plurality of particles 20 and at least partially to the shape of a wearer's foot when foot pressure is applied to the various portions of the inner sole 14. Moreover, the flexible characteristics of the inner sole 14 as well as the reduced thickness thereof allow it to return to a normal position or configuration upon the removal or reduction of foot pressure to the various portions of the inner sole 14.

Similarly, the flexible material of the shell 24 also includes sufficient resiliency to expand or be "deformed" into an outwardly extended relation to corresponding sides of the upper 12 when foot pressure is applied to the inner sole 14 and outer sole 16, such as when the wearer is involved in walking, running, standing, etc. As will be explained in greater detail with regard to FIGS. 2A-2C, 3A-3C, 4A-4B, and 5A-5D, foot pressure will be typically applied substantially successively to different portions of the inner sole 14, the shell 24 and the plurality of particles 20, as the wearer walks or runs.

In order to further clarify the operative and structural features of the present invention, the following reference designations appear in the accompanying figures, and will denote indicated dimensional characteristics and/or changes in the configuration of various portions of the footwear 10. Such dimensional characteristics and changes in configuration are at least partially dependent on which part of the footwear assembly 10 the foot pressure is applied. More specifically, the designation "H" will denote heel-width; "F" will denote forefoot width; "LH" will denote lateral heel height and the designation "LF" will denote lateral forefoot height.

Figure 1A:
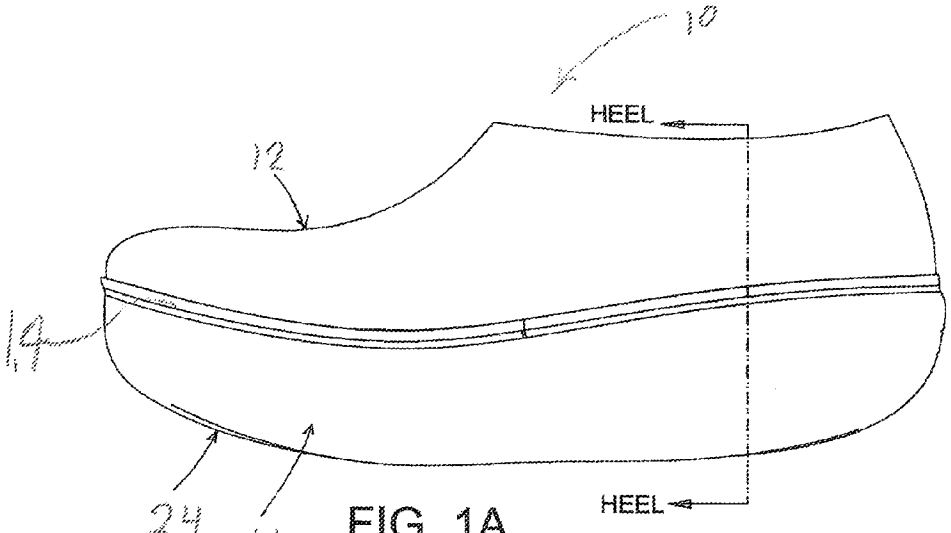
FIG. 1A is a side view of one embodiment of the footwear assembly of the present invention.
Figure 1C:
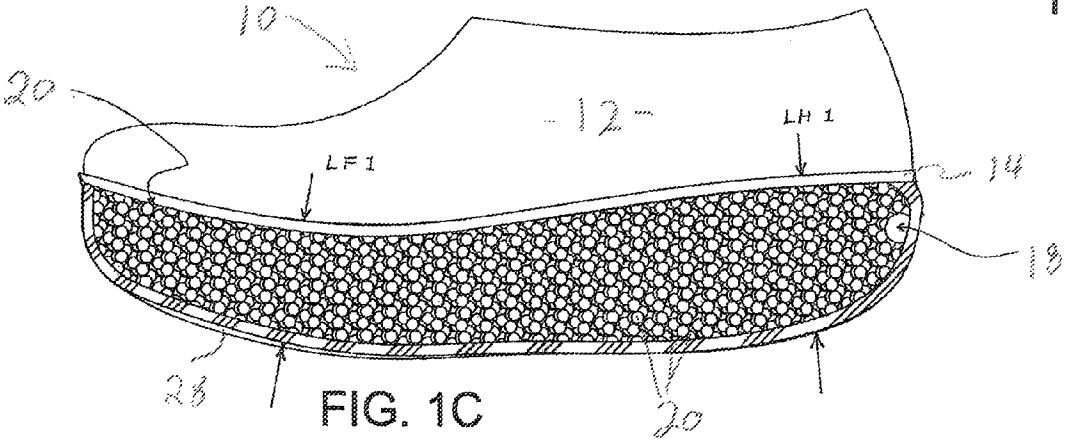
FIG. 1C is a longitudinal sectional view of the embodiment of FIGS. 1A and 1B.

Therefore, with primary reference to FIGS. 1A-1C, the footwear assembly 10 is presented in a normal, substantially "non-compressed orientation". As used herein, the term "non-compressed orientation" is meant to at least include a reduction or absence of foot pressure being applied to the inner sole 14, the plurality of particles 20 and/or the shell 24 of the outer sole 16. As such, it will be noted that the lateral heel height (LH1) and the lateral forefoot height (LF1) are represented in their non-compressed orientation. Similarly, as illustrated in FIG. 1B, the forefoot width (F1) and the heel width (H1) are depicted.

Figure 2B:
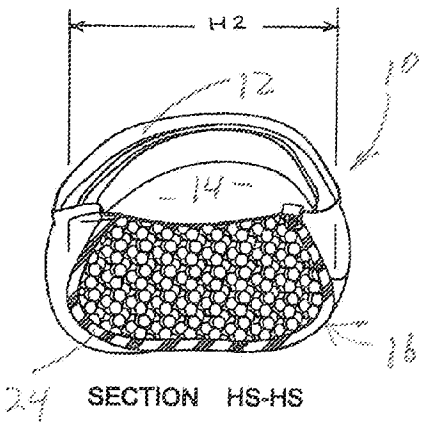
FIG. 2B is a transverse sectional view along a corresponding section line of FIG. 2A.
Figure 2A:
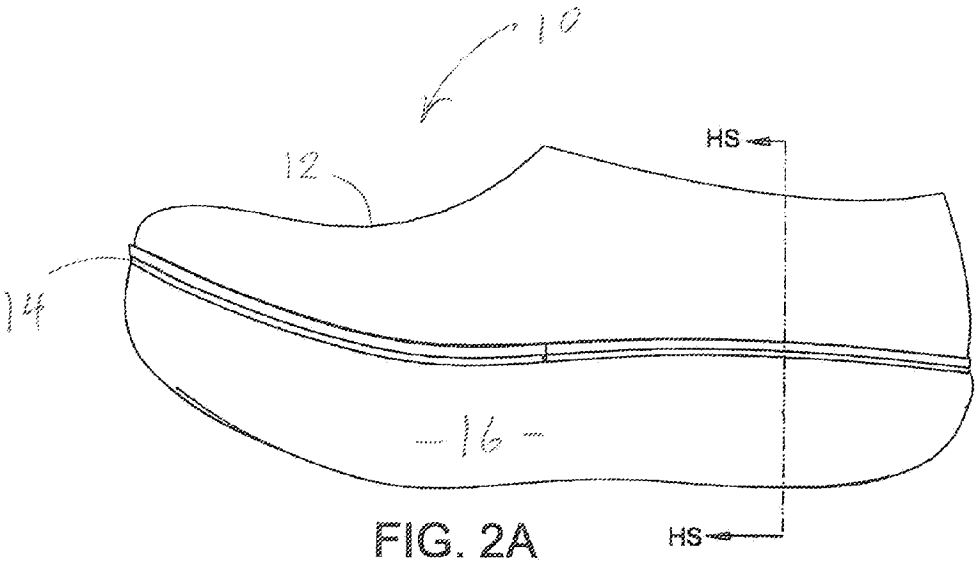
FIG. 2A is a side view of the embodiment of FIGS. 1A-1C in a "heel strike position".
Figure 2C:
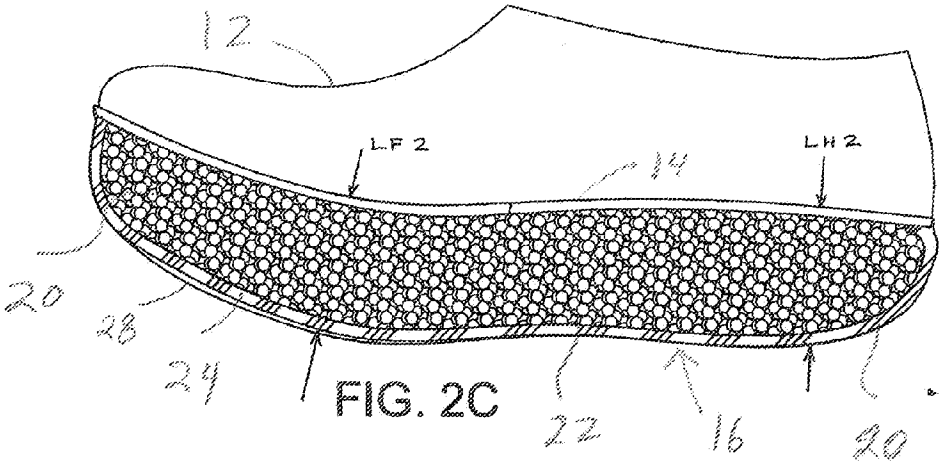
FIG. 2C is a longitudinal sectional view of the embodiment of FIGS. 2A and 2B.

FIGS. 2A-2C represents the footwear assembly 10 in a "heel strike position". This may be exemplified by a substantially first contact of the footwear assembly 10 with a supporting surface during a conventional walking step. As such, foot pressure is applied to the inner sole 14, the plurality of particles 20 and the flexible material shell 24, primarily in the area of the heel of the footwear assembly 10. As a result, at least a heel of the footwear assembly 10 will be in a "compressed orientation". This in turn results in a reduction of the lateral heel height (LH2) and a substantially outward expansion of a corresponding heel portion of the outer shell 24. As should be apparent, the foot pressure being applied to the heel will result in compressive forces being transferred to the correspondingly disposed plurality of particles 20, causing their movement relative to one another and to the inner surface of the shell 24 within the hollow interior 18. Accordingly, the resiliency of the flexible material from which the shell 24 is formed is sufficient to allow the laterally outward extension thereof towards and/or beyond the corresponding sides of the upper 12. A variable configuration of the shell 24 and outer sole 16 occurs dependent, at least in part, on which portion of the footwear assembly 10 foot pressure is applied. Further, as represented in FIG. 2C, the compression of the plurality of particles 20 disposed in corresponding relation to the heel of the footwear assembly 10 serves to force the fluidic movement of the plurality of particles 20 towards the mid-portion or front portion of the footwear assembly 10. This in turn results in the lateral forefoot height (LF2), being greater than the lateral forefoot height (LF1), at least partially because of the flow of particles 20 from the heel towards the forefoot and the substantially compressed orientation of the heel of the footwear assembly 10 and the mid-portion of the footwear 10 being in a substantially non-compressed orientation.

Figure 4B:
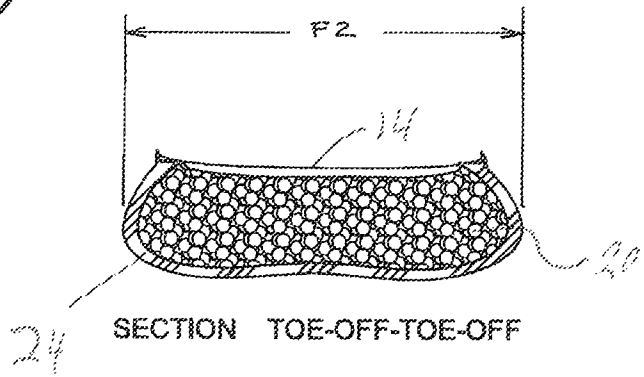
FIG. 4B is a transverse sectional view along a corresponding section line of FIG. 4A.
Figure 4A:
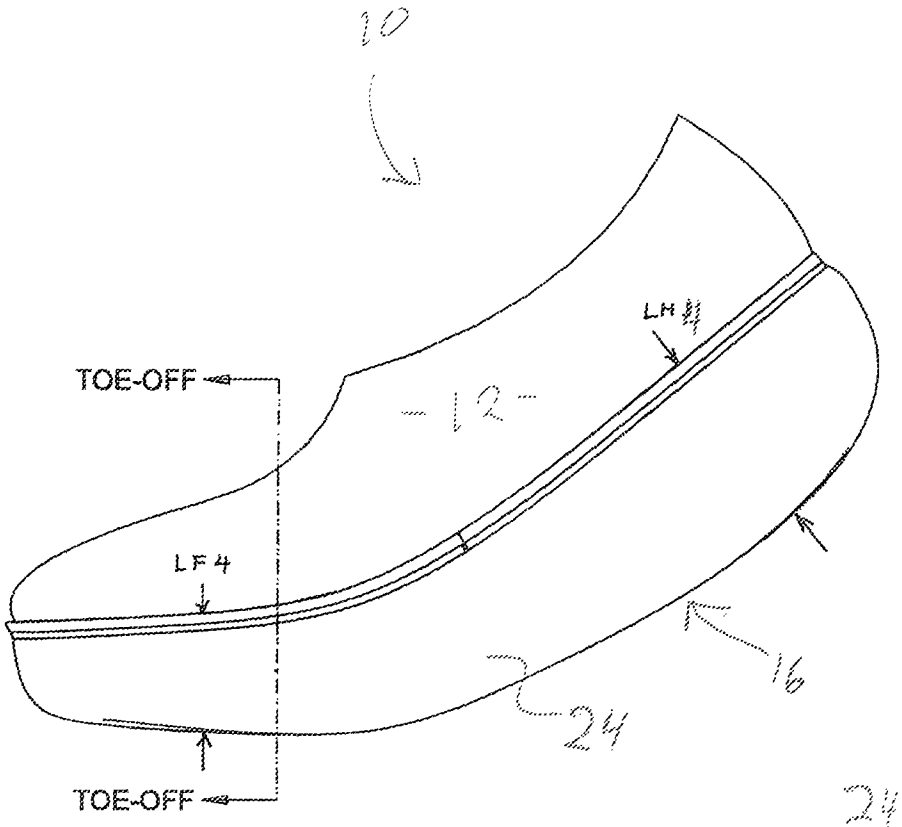
FIG. 4A is a side view of the embodiment of FIGS. 1-3 in a "toe-off position".

With primary reference to FIGS. 3A-3C, the footwear assembly 10 is represented in a substantially or at least partially balanced position, wherein the foot pressure applied by the wearer is applied substantially across the entire inner sole 14, the outer sole 16, the plurality of particles 20, and the shell 24. In such a position, the footwear assembly 10 is passing from the "heel strike position" of FIG. 2A-2C and is approaching the "toe off position" as represented in FIGS. 4A and 4B. More specifically, as foot pressure is reduced relative to the heel portion of the footwear assembly 10, the height thereof (LH3) increases, wherein the height of the lateral forefoot (LF3) is decreased. Therefore, the heel portion of the foot assembly 10 can be described as being at least partially in a non-compressed orientation, wherein the lateral foot portion (LF3) of the footwear assembly 10 is assuming a compressed orientation.

With regard to FIG. 3B, the substantial center or mid-portion of the footwear assembly 10 is also shown in an at least partially compressed orientation relating in the particles 20 being compressed relative to one another causing their forced movement. Moreover, such compression causes an outward expansion of the lateral sides of the shell 24 in addition to a reduction in the lateral forefoot height (LF3). More in particular, the flexible material of the inner sole 14, as well as that of the shell 24 includes sufficient resiliency to be normally biased into a substantially non-compressed orientation. This biasing force serves to return both the inner sole 14, the outer shell 24, and the plurality of particles 20 into the normal, substantially non-compressed orientation, as represented in FIGS. 1A-1C, dependent on which portion of the footwear assembly 10 has a reduction of foot pressure thereon.

FIGS. 4A and 4B represent the footwear assembly 10 in a complete "toe off position", wherein foot pressure on the heel and center or mid-portion of the footwear assembly 10 is substantially eliminated or significantly reduced. Therefore, the lateral forefoot height (LF4) is significantly reduced thereby placing the heel and the mid-portion of the footwear assembly 10 in a non-compressed orientation, as described above. In contrast, the lateral forefoot height (LF4) is substantially reduced from (LF1) as depicted in FIG. 1C. This is due to the fact that the corresponding lateral forefoot portion of the inner sole 14, the shell 24, and the plurality of particles 20 are in a substantially compressed orientation based on the foot pressure being primarily directed to this area of the footwear assembly 10. As a result, the side portions of the shell 24 extend laterally outward towards and/or beyond the corresponding sides of the upper 12, as well as the periphery of the inner sole 14. At the same time, the lateral heel height (LH1) and (LH4), as respectively represented in FIGS. 1C and 4A, are substantially equal due to the absence of foot pressure on the heel portion.

Figures 5A, 5B, 5C, 5D:
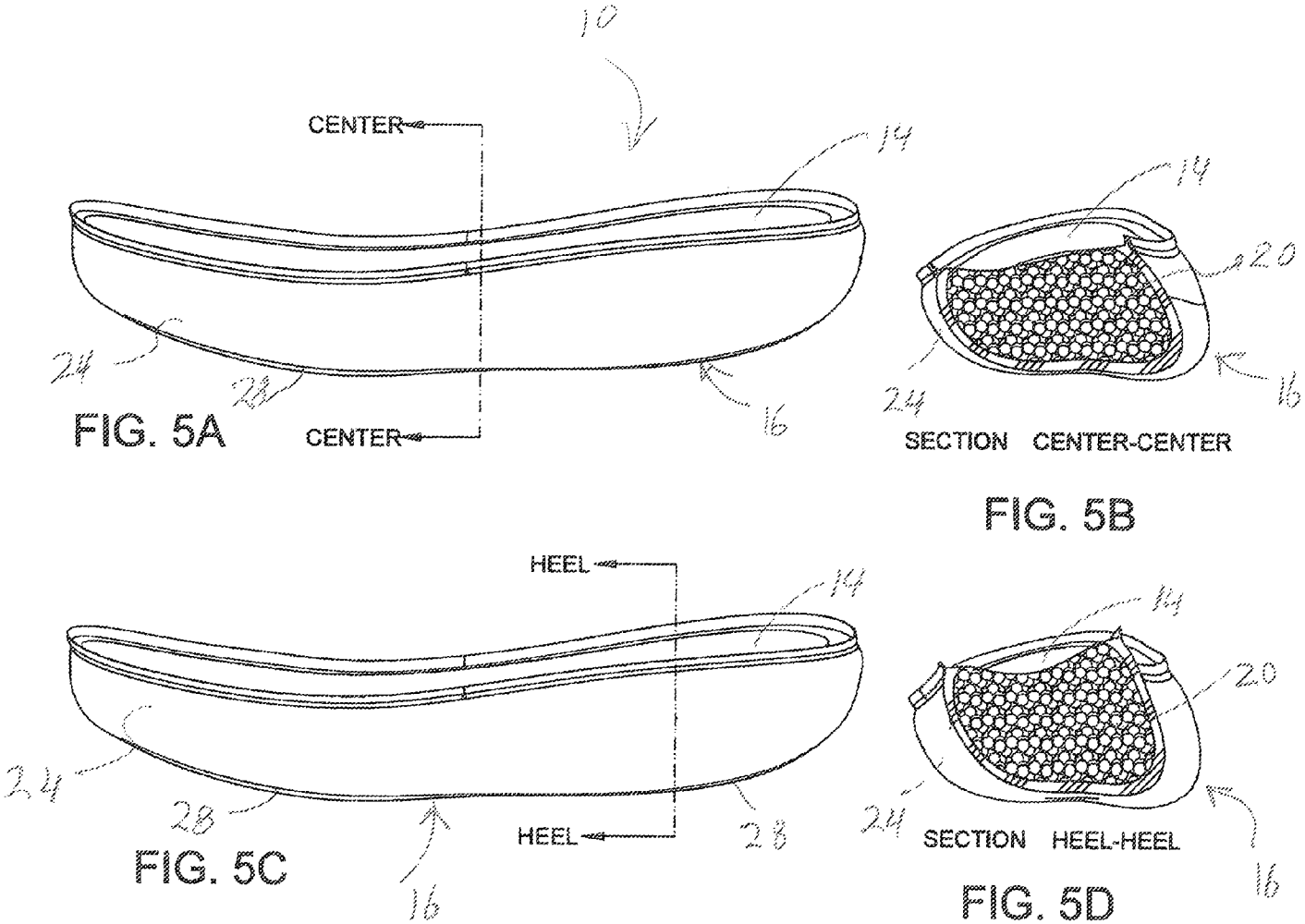
FIG. 5A is a side perspective view of the embodiment of FIGS. 1-4.
FIG. 5B is a transverse sectional view along a corresponding section line of the embodiment of FIG. 5A.
FIG. 5C is a side perspective view of the embodiment of FIG. 5A.
FIG. 5D is a transverse sectional view along a corresponding section line of FIG. 5C.

With primary reference to FIGS. 5A-5D, the footwear assembly 10 is represented, wherein the foot pressure is being applied or at least mostly concentrated on one side of the footwear assembly 10 by the wearer. While these Figures specifically demonstrate the foot pressure being applied to the outer side, it should be apparent that the foot pressure could be concentrated on either the outer side or the inner side of the footwear assembly 10, and provide corresponding results. Accordingly, both the center or mid-portion of the footwear assembly 10, as represented in FIG. 5B, as well as the heel portion thereof, as represented in FIG. 5D, demonstrates another of a plurality of variable configurations of the outer sole 16 and flexible material shell 24, as well as the plurality of particles 20 and the inner sole 14. Therefore, the versatility of the structure of the footwear assembly 10 facilitates the ability to force the outer side (or inner side) of the footwear assembly 10 into a substantially compressed orientation, while the opposite side of the footwear assembly 10 remains in a substantially non-compressed orientation. This in turn results in correspondingly disposed particles 20 on the compressed side, be it the outer side or inner side, being substantially compressed causing their interaction with one another and the flow of particles 20 from the compressed side towards the opposite or non-compressed side, as well as other areas of the hollow interior 18 of the footwear assembly 10. It is again emphasized that the representations of FIGS. 5B and 5D demonstrate the foot pressure is being concentrated only to the outer side. However, the foot pressure could just as easily be applied or concentrated on either the outer side or inner side, with corresponding results relating to the flow of the particles towards the opposite or non-compressed side. Accordingly, the footwear assembly 10 may demonstrate a desired amount of instability even when the wearer is standing rather than walking or running.

As also represented throughout the accompanying Figures, additional features of the footwear assembly 10 include the plurality of particles 20 being of different sizes, wherein the size of each of the plurality of particles 20 are preferably within certain dimensional ranges. Also, the appropriate sizing of the plurality of particles 20 along with the flexibility and reduced thickness of the inner sole 14 provide a "massaging action" to the foot of the wearer as the footwear assembly 10 and corresponding foot proceed through normal, successive positions while walking, running, etc. Therefore, the structural and operative features of the footwear assembly 10 at least partially mimic the wearer walking barefoot in loose sand. Accordingly, when the footwear assembly 10 of the present invention is worn, the structural and operative features thereof will result in a taxation of the locomotive forces of the corresponding foot and leg when walking, running, etc. As a result minor stability adjustments will be made allowing or automatically requiring the wearer to exercise corresponding feet and leg muscles. The promotion of full body stabilization by the footwear assembly 10 creating minimal instabilities when worn will serve to trigger muscles that are infrequently used. The ability to exercise the feet and leg muscles in place, by moving the soles of the feet over the ever-changing particles 20 and shell 24 of the outer sole 16 has excellent health benefits.

Also, the intended and at least minimal instability of the footwear assembly 10 provides for the strengthening and/or exercising of the muscles and tendons of the foot and lower leg portion of the wearer, due to the fact that the wearer will automatically or inherently tend to overcome the intended instability provided by the interaction of the various components of the footwear assembly 10.

Yet additional features of one or more embodiments of the footwear assembly 10 is the inclusion of a tread structure comprising an array of treads or treaded portions, schematically represented as 28, on the under and/or outer exposed surfaces of the shell 24 or outer sole 16. Such treads or treaded portions 28 may vary in dimension, configuration, location and overall structure as formed on the outer exposed surfaces of the shell 24 or outer sole 16, as is appropriate to the size, design and intended use of the footwear 10. However, the provision of the treads or treaded portions 28 should be adequate to provide traction even when the shell 24 and/or outer sole 16 assume a variety of different configurations as set forth above. In turn, sufficient traction may facilitate a wearer making the appropriate "stability adjustments", as set forth above.

Since many modifications, variations and changes in detail can be made to the described embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A footwear assembly structured to require stability adjustments of a wearer while in use, the footwear assembly comprising:

an upper, an outer sole, and an inner sole disposed in segregating relation between the upper and the outer sole, the outer sole including a hollow interior and a particulate filler disposed therein, the particulate filler comprising a plurality of unconnected free flowing particles, the hollow interior of the outer sole is substantially filled with the plurality of particles, the plurality of particles formed of a nondeformable material disposable into and out of movable engagement relative to one another and relative to an inner surface of the outer sole at least upon an application of foot pressure to the outer sole, and the outer sole including a shell having a base and an upwardly extending side wall formed of a flexible material and disposed in retaining relation to the plurality of particles, wherein at least a portion of the side wall is deformed outwardly beyond a periphery of the inner sole as a result of outward movement of at least some of said plurality of particles within the shell upon an application of foot pressure to the outer sole.

2. The footwear assembly as recited in claim 1 wherein the shell and the plurality of particles are collectively structured to define variable configurations of the shell dependent at least in part on foot pressure being applied to the outer sole.

3. The footwear assembly as recited in claim 1 wherein the hollow interior extends in underlying relation to at least the majority of the inner sole.

4. The footwear assembly as recited in claim 2 wherein the inner sole is dimensioned and structured to at least partially conform to a configuration of underlying, correspondingly disposed portions of the plurality of particles at least upon an application of foot pressure to the inner sole.

5. The footwear assembly as recited in claim 2 wherein the inner sole comprises a flexible material having sufficiently reduced thickness to at least partially conform to a configuration of the correspondingly disposed plurality of particles and to a corresponding portion of a wearer's foot upon an application of foot pressure to the inner sole.

6. The footwear assembly as recited in claim 1 wherein the inner sole and the plurality of particles are collectively structured to define a variable configuration of the shell dependent at least in part upon an application of foot pressure to the outer sole.

7. The footwear assembly as recited in claim 6 wherein the shell and the plurality of particles are collectively structured to define variable configurations of the shell dependent at least in part upon a location of an application of foot pressure to the inner sole.

8. The footwear assembly as recited in claim 7 wherein the inner sole comprises a flexible material having a sufficiently reduced thickness to at least partially conform to a configuration of the corresponding plurality of particles and to a corresponding portion of a wearer's foot upon an application of foot pressure to the inner sole.

9. The footwear assembly as recited in claim 1 wherein the plurality of particles are formed of a rigid non-deformable material.

10. The footwear assembly as recited in claim 9 wherein the shell is formed of a flexible material having sufficient resiliency to extend laterally outward towards corresponding sides of the upper upon an application of foot pressure to the outer sole.

11. The footwear assembly as recited in claim 10 wherein the shell is sufficiently resilient to move between the laterally outward extension and a substantially normal, non-compressed orientation upon a reduction of foot pressure to the outer sole.

12. A footwear assembly structured to require stability adjustment by a wearer concurrent to an application of foot pressure thereto, the assembly comprising:

an upper, an inner sole, and an outer sole, the upper structured for retention on a foot of a wearer, the outer sole including a hollow interior, the hollow interior substantially filled with a plurality of unconnected free flowing particles, the outer sole including a shell having a base and a side wall formed of a flexible material disposed in retaining, at least partially enclosing relation to the plurality of particles, a tread structure formed on outer exposed portions of the outer sole, the plurality of particles formed of a rigid substantially non-deformable material and disposable into and out of movable engagement with one another and inner surfaces of the shell, and the inner sole, the shell and the plurality of particles being collectively structured to define variable configurations of the shell dependent at least in part upon an application of foot pressure to different portions of the outer sole, wherein the rigid substantially non-deformable particles and the flexible side wall of the shell cooperate to provide, upon an application of foot pressure to the outer sole, movement of the rigid substantially non-deformable particles within the shell to cause at least a portion of the side wall to extend outwardly into the variable configurations.

13. The footwear assembly as recited in claim 12 wherein the hollow interior extends in underlying relation to at least a majority of the inner sole, the inner sole comprising sufficient flexibility to at least partially conform to correspondingly disposed portions of the plurality of particles upon foot pressure being applied thereto.

14. The footwear assembly as recited in claim 13 wherein the inner sole, the plurality of particles and the shell are cooperatively disposed and dimensioned to facilitate a massaging action being applied to the foot during walking.

15. The footwear assembly as recited in claim 12 wherein the flexible material of the shell is sufficiently resilient to have different portions thereof extend laterally outward and beyond corresponding sides of the upper upon an application of foot pressure to different portions of the outer sole.

16. The footwear assembly as recited in claim 15 wherein the shell is sufficiently resilient to move between said laterally outward extension and a normal, substantially non-compressed orientation.

17. The footwear assembly as recited in claim 12 wherein the flexible material of the shell is sufficiently resilient to move between a compressed orientation and a non-compressed orientation, the compressed orientation comprising at least a portion of the shell and some of said plurality of particles retained therein extending laterally outward and beyond a corresponding side of the upper.

18. The footwear assembly as recited in claim 17 wherein the compressed orientation being at least partially defined by an application of foot pressure to at least the portion of the shell, the non-compressed orientation being at least partially defined by a reduction of foot pressure on the outer sole.

19. The footwear assembly as recited in claim 17 wherein the flexible material of the shell is sufficiently resilient to normally bias the shell into the non-compressed orientation.

20. The footwear assembly as recited in claim 12 wherein the plurality of particles are disposed in an enclosed relation within the hollow interior by the inner sole and the shell.

21. The footwear assembly as recited in claim 12 wherein the plurality of particles are generally spherical.

* * * * *